US006675947B2

(12) United States Patent
Kiva et al.

(10) Patent No.: US 6,675,947 B2
(45) Date of Patent: Jan. 13, 2004

(54) RECYCLING MACHINE WITH CONTAINER COMPACTING SYSTEM

(75) Inventors: Kris M. Kiva, Portland, OR (US); Stuart R. Aldrich, Portland, OR (US); John A. Coyne, Milwaukie, OR (US)

(73) Assignee: Can & Bottle Systems, Inc., Portland, OR (US)

( * ) Notice: Subject to any disclaimer, the term of this patent is extended or adjusted under 35 U.S.C. 154(b) by 35 days.

(21) Appl. No.: 10/112,581

(22) Filed: Mar. 29, 2002

(65) Prior Publication Data

US 2003/0010597 A1 Jan. 16, 2003

Related U.S. Application Data

(60) Provisional application No. 60/280,546, filed on Mar. 30, 2001.

(51) Int. Cl.[7] ..... G07F 7/06; B30B 1/26; B02C 19/12; B02C 1/02

(52) U.S. Cl. ..... 194/208; 209/522; 100/292; 100/902; 241/99; 241/267

(58) Field of Search ..... 194/208, 209, 194/205; 209/10, 522; 100/3, 39, 46, 51, 94, 98 R, 137, 214, 233, 263, 291, 292, 902; 241/99, 198.1, 262, 267

(56) References Cited

U.S. PATENT DOCUMENTS

| | | | | |
|---|---|---|---|---|
| 887,003 A | | 5/1908 | Michaelsen | |
| 1,268,479 A | | 6/1918 | Liggett | |
| 1,803,585 A | | 5/1931 | Battey | |
| 3,249,203 A | | 5/1966 | Aidlin | 198/33 |
| 3,295,659 A | | 1/1967 | Aidlin | 198/33 |
| 3,412,837 A | | 11/1968 | Myers | 194/4 |
| 3,504,621 A | | 4/1970 | Qualheim | 100/96 |
| 3,556,282 A | | 1/1971 | Moeltzner | 198/33 |
| 3,635,325 A | | 1/1972 | Sterling | 198/33 |
| 3,690,437 A | | 9/1972 | Kammann | 198/33 |
| 3,772,985 A | * | 11/1973 | Girten | 100/282 |
| 3,792,765 A | | 2/1974 | Arp | 194/4 C |
| 3,827,351 A | | 8/1974 | Rosenow | 100/176 |
| 4,069,928 A | | 1/1978 | Teske et al. | 214/17 DC |
| 4,119,024 A | * | 10/1978 | White | 100/35 |
| 4,120,240 A | * | 10/1978 | Smith | 100/45 |
| 4,130,194 A | | 12/1978 | Schindel et al. | 198/397 |
| 4,241,821 A | | 12/1980 | Wu et al. | 194/4 C |
| 4,342,385 A | | 8/1982 | Kaspar | 194/4 D |
| 4,345,679 A | | 8/1982 | DeWoolfson | 194/4 C |
| 4,445,430 A | | 5/1984 | Pyne et al. | 100/35 |
| 4,454,028 A | | 6/1984 | Vetter et al. | 209/548 |

(List continued on next page.)

FOREIGN PATENT DOCUMENTS

| | | | | |
|---|---|---|---|---|
| GB | 419417 | | 11/1934 | |
| JP | 53-116667 | | 10/1978 | B65G/47/24 |
| JP | 55-68199 A | * | 5/1980 | B30B/9/32 |
| JP | 58-119498 A | * | 7/1983 | B30B/9/32 |
| WO | WO98/02256 | | 1/1998 | B07C/5/34 |
| WO | WO98/57308 | | 12/1998 | G07F/7/06 |
| WO | WO99/30292 | | 6/1999 | G07F/7/06 |
| WO | WO00/63853 | | 10/2000 | G07F/7/06 |

*Primary Examiner*—Donald P. Walsh
*Assistant Examiner*—Mark J. Beauchaine
(74) *Attorney, Agent, or Firm*—Kolisch Hartwell, P.C.

(57) ABSTRACT

A recycling machine is provided which compacts containers using a multi-purpose compacting system which includes a roller assembly having a roller configured to draw containers through an adjustable container-receiving throat. The compacting system also includes a base plate assembly with a movable base plate which at least partially defines the throat, the base plate being mounted for movement between a first orientation wherein the base plate is a first predetermined distance from the roller so as to define an open container-receiving throat, and a second orientation wherein the base plate is a second lesser predetermined distance from the roller so as to close the container-receiving throat. The throat typically is closed as the container passes between the roller and the base plate so as to compact the container therebetween.

14 Claims, 8 Drawing Sheets

U.S. PATENT DOCUMENTS

| | | | | |
|---|---|---|---|---|
| 4,480,737 | A | 11/1984 | Jamgochian et al. | 194/4 C |
| 4,492,295 | A | 1/1985 | DeWoolfson | 194/4 C |
| 4,505,370 | A | 3/1985 | Swenck | 194/4 C |
| 4,512,253 | A | 4/1985 | La Barge et al. | 100/53 |
| 4,653,627 | A | 3/1987 | Hampson et al. | 194/209 |
| 4,792,765 | A | 12/1988 | Smith et al. | 330/4.3 |
| 4,879,025 | A | 11/1989 | Shapcott | 209/559 |
| 4,915,205 | A | 4/1990 | Reid et al. | 194/205 |
| 4,949,834 | A | 8/1990 | Schindel | 198/392 |
| 5,090,031 | A | 2/1992 | Pyne et al. | 377/6 |
| 5,152,387 | A | 10/1992 | Hammond | 194/208 |
| 5,161,661 | A | 11/1992 | Hammond | 194/209 |
| 5,165,564 | A | 11/1992 | Prout et al. | 220/254 |
| 5,195,429 | A | 3/1993 | Firpo | 100/96 |
| 5,211,109 | A | 5/1993 | Determan | 100/98 R |
| 5,273,149 | A | 12/1993 | Aldrich et al. | 194/205 |
| 5,273,150 | A | 12/1993 | Koivisto et al. | 194/209 |
| 5,361,913 | A | 11/1994 | Melchionna | 209/583 |
| 5,435,445 | A | 7/1995 | Dellinger, Jr. et al. | 209/576 |
| 5,485,964 | A | 1/1996 | Booth et al. | 241/47 |
| 5,624,018 | A | 4/1997 | Schuff et al. | 194/209 |
| 5,927,462 | A | 7/1999 | Kiva et al. | 194/208 |
| 6,186,308 | B1 | 2/2001 | Coyne et al. | 194/209 |
| 6,547,055 | B2 | 4/2003 | Coyne et al. | 194/207 |

* cited by examiner

RECYCLING MACHINE WITH CONTAINER COMPACTING SYSTEM

CROSS-REFERENCE TO RELATED APPLICATION

This application claims priority from U.S. Provisional Patent Application Serial No. 60/280,546 entitled RECYCLING MACHINE WITH CONTAINER COMPACTING SYSTEM, filed on Mar. 30, 2001.

TECHNICAL FIELD

The present invention relates generally to recycling, and more particularly, to a recycling machine which includes a system for compacting recyclable containers of various shape and size.

BACKGROUND ART

With problems such as pollution, limited natural resources, and the ever-increasing cost of most materials, more and more people are looking toward recycling as a way of improving the world in which they live. For example, many states have enacted legislation which requires that beverage containers carry a redemption deposit as a technique for encouraging recycling and discouraging littering. In other states, there have been extensive efforts to encourage voluntary recycling of beverage containers, even in the absence of required redemption deposits. As such, there has developed a need for efficient systems whereby beverage containers such as metal cans, plastic bottles, and glass bottles may efficiently be processed.

In the past, recycling centers (e.g., retail stores) have had to utilize personnel to sort and count returned containers so that such containers could be properly compacted, or returned to the proper distributor for redemption. This arrangement also has required devotion of an inordinate proportion of the available floor space to the collection, sorting, counting, compacting and storage of the various types of containers which are recycled. Recycling thus has proven unacceptably expensive. Recycling centers thus have sought an all-in-one recycling machine capable of accepting various types of containers for selected compacting and storage operations. Container redeemers also have sought a recycling machine capable of compacting and storing containers based on the type of container provided. To this end, there has been a flurry of activity in the development of conveniently used recycling machines and techniques for the intake, or reverse vending, of recyclable containers such as bottles and cans.

One particularly useful reverse vending machine is illustrated and described in U.S. Pat. No. 4,653,627, which issued on Mar. 31, 1987 to Hampson et al. That patent discloses a reverse vending machine which provides for the separation, counting and crushing of beverage containers of a predetermined type. The machine is specifically adapted for use in redemption of containers having a known size and having a composition which is similarly known. The invention was improved upon by a machine including a rotary-bristle drive scanning station which aids in accurately identifying containers which are redeemed. That machine is set forth in U.S. Pat. No. 5,273,149, which issued on Dec. 28, 1993 to Aldrich et al. Both of these inventions are commonly owned with the present invention and are incorporated herein by this reference thereto.

Although the aforementioned reverse vending machines have proven extremely effective in the recycling of cans, and particularly in the redemption of standard-size beverage cans, such machines have not addressed the more diverse redemption needs of most recycling centers. What is needed is a machine capable of redeeming various size and style containers, all in a single machine. It is therefore an object of the invention to provide an improved recycling machine wherein containers of different character may be reliably identified and compacted for storage in an appropriate storage bin.

SUMMARY OF THE INVENTION

As will be evident from the following description, the invented recycling machine compacts containers using a multi-purpose compacting system which includes a roller assembly having a roller configured to draw containers through an adjustable container-receiving throat. The compacting system also includes a base plate assembly with a movable base plate which at least partially defines the throat, the base plate being mounted for movement between a first orientation wherein the base plate is a first predetermined distance from the roller so as to define an open container-receiving throat, and a second orientation wherein the base plate is a second lesser predetermined distance from the roller so as to close the container-receiving throat. The throat typically is closed as the container passes between the roller and the base plate so as to compact the container therebetween.

In the preferred embodiment, the roller includes a cam mounted for rotation with the roller, the cam being configured to effect pivot of the base plate so as to open and close the container-receiving throat. Correspondingly, the base plate assembly includes a cam follower which is secured to the base plate, the cam follower being adapted to ride on the cam as the roller rotates. The cam is eccentric, and is contoured to reciprocate the base plate gradually between a open-throat first orientation and a closed-throat second orientation with each revolution of the roller. Preferably, the cam is divided into four equal quadrants, including a withdraw region whereby the cam provides for movement of the base plate toward the first orientation, a first dwell region whereby the cam maintains the base plate in the first orientation, an advance region whereby the cam provides for movement of the cam toward the second orientation, and a second dwell region whereby the cam maintains the base plate in the second orientation.

The recycling machine typically includes a frame having an on-load station which receives containers lengthwise along a feed axis, the on-load station housing a pair of rollers which impart axial-rotary motion to a fed container so that it may be identified by an adjacent sensor. A conveyer mechanism directs the identified container from the on-load station to a container compactor which corresponds to the container type. The container then is compacted and stored in an appropriate bin.

These and other objects and advantages of the instant invention will become more fully apparent as the description which follows is read in conjunction with the appended drawings and the claims.

DETAILED DESCRIPTION OF THE PREFERRED EMBODIMENT AND BEST MODE FOR CARRYING OUT THE INVENTION

Figure 1:
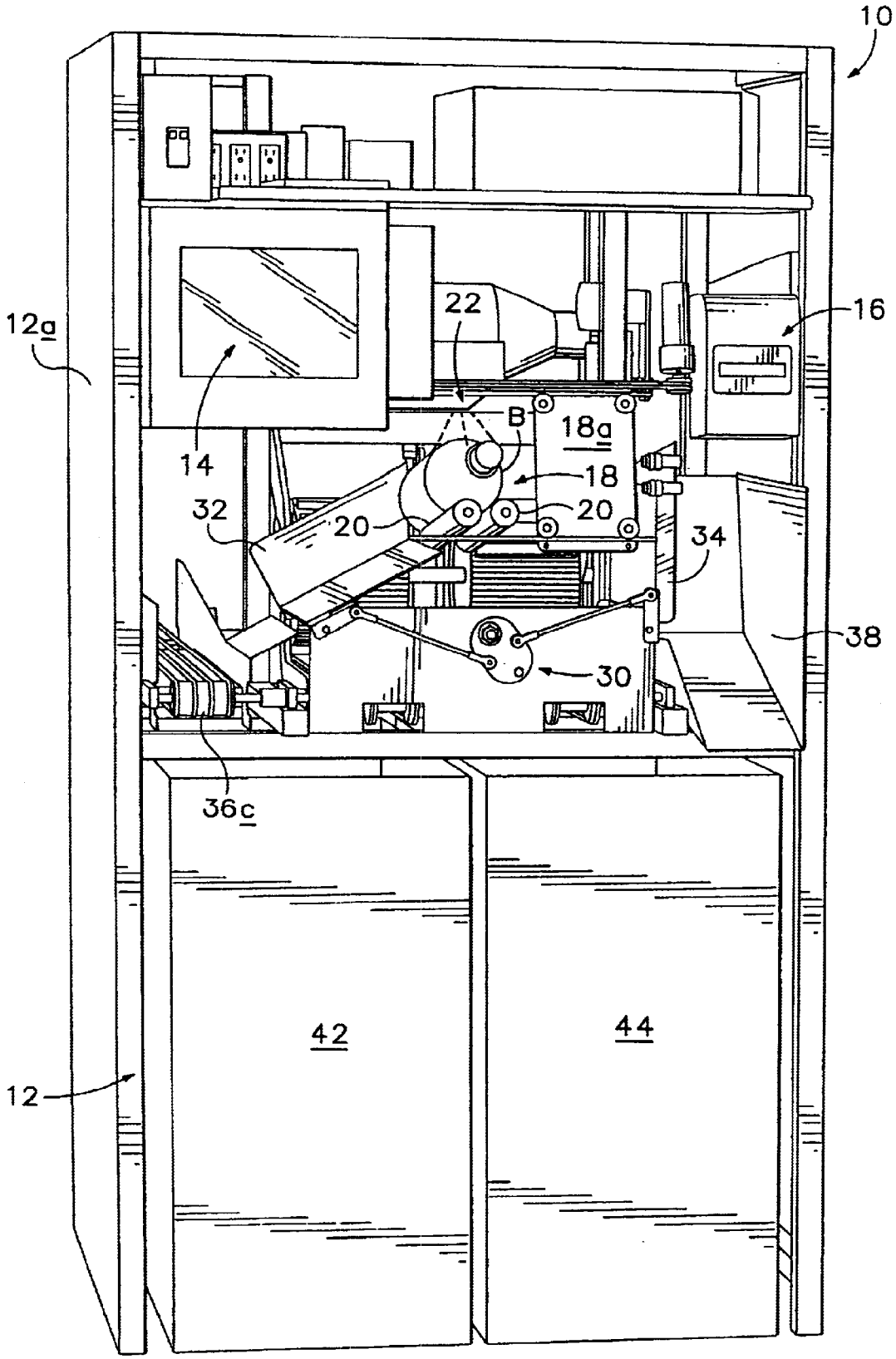
FIG. 1 is a somewhat simplified isometric view of a recycling machine constructed in accordance with the present invention.

A recycling machine constructed in accordance with the present invention is shown at 10 in FIG. 1, the depicted machine being configured to identify, sort and compact recyclable beverage containers such as that shown. In the preferred embodiment, recycling machine 10 takes the form of a reverse vending machine suited for use in recycling redeemable beverage containers, including both cans and bottles, regardless of whether such containers are made from metal, plastic or glass. It will be understood, however, that the invented recycling machine could be adapted to process various other recyclable materials without departing from the invention as claimed.

As indicated, recycling machine 10 includes a cabinet defined by a generally rectangular frame 12 fitted with a plurality of panels such as that shown at 12*a*. The panels enclose the machine's working components, protecting the machine from prying fingers and the user from inadvertent harm. A front panel of the cabinet takes the form, generally, of a door which is removable (or openable) to reveal the interior of the machine. The machine thus may be serviced or inspected as necessary. In FIG. 1, the cabinet's front panel has been removed so as to reveal the container-processing components of the machine.

A controller 14 (including a PC, a monitor, and other control circuitry) is operable by a keyboard (not shown) to direct operation of the machine. For example, the controller may be used to define particular operational parameters of the machine, to define the character or extent of a user interface display, and/or to identify the form of redemption compensation (e.g., cash, coupon or receipt). Accordingly, the depicted machine also includes a redemption mechanism such as receipt dispensing mechanism 16 which dispenses receipts/coupons to users based on the redemption value of the recyclable beverage containers which they provide.

Containers are provided through a input port to an on-load station 18 which is configured to receive individual containers lengthwise along a generally horizontal feed axis. One such container is illustrated in FIG. 1 at B, container B taking the form of a 2-liter plastic bottle of the variety conventionally used to hold a soft drink. It will be appreciated, however, that various size and type containers may be received for redemption, including, for example, various different-sized plastic bottles, glass bottles or metal cans.

For safety, the machine is fitted with a sliding feed door 18*a* which selectively closes the input port to prevent operators from inserting their hands into the machine during machine operation. This prevents injury, and prevents attempts to cheat the machine (i.e., by removing containers once detected as described below). The door preferably is automatically closed upon passage of a container through the input port, closure generally being effected upon detection of a container within the on-load station.

Once a container is placed in the on-load station, the container is rotated by a pair of rollers 20 which impart axial-rotary motion to the container to facilitate identification thereof. The rollers typically impart such axial-rotary motion by frictional engagement of the rollers with the container, the container generally being kept within the on-load station by a pair of pivotal walls (not shown).

The container type is determined while the container is in the on-load station, such identification being accomplished using a sensor 22 which, in the depicted embodiment, is mounted on the machine's frame. The sensor typically takes the form of an optical scanner which is capable of reading a code on the beverage container, and optimally is configured to read side-borne bar codes of the type used to identify most products which are sold retail. These codes, it will be noted, generally contain information which identifies the nature of the container (i.e., material, color, size), information which is useful in selecting an appropriate feed path.

Upon identification of the container, or after a predetermined duration of time has passed without identification of the container, the container is moved from the on-load station along a feed path determined in accordance with the identified container type. This is accomplished via a conveyor mechanism 30 which is adjustable to define various feed paths. Conveyer mechanism 30 thus will be seen to include a pair of pivotal ramps 32, 34 which may be adjusted to direct an identified container to either: a metal can conveyer 36*a*; a plastic bottle conveyer 36*b*; a glass bottle conveyer 36*c*; or a reject chute 38.

Figure 2:
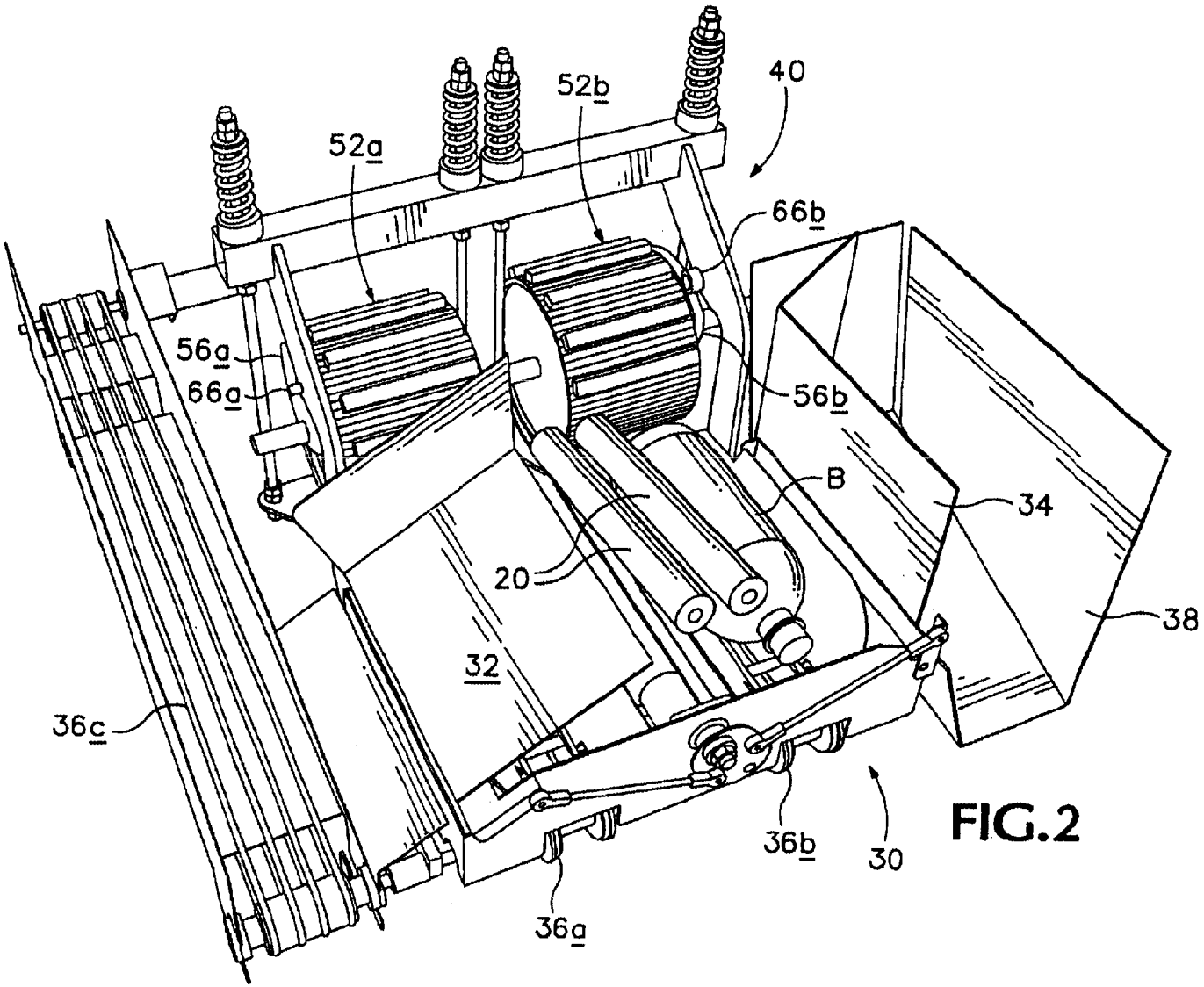
FIG. 2 is a further simplified isometric view of the recycling machine of FIG. 1 demonstrating advancement of a plastic bottle along a plastic bottle feed path.

In FIGS. 1 and 2, the ramps are in a first configuration wherein ramp 32 defines a feed path for glass bottles, and ramp 34 defines a feed path for plastic bottles. If the container is identified as a glass bottle, it is fed downward along ramp 32 (typically by a kicker in the on-load station) to glass bottle conveyer 36*c*. Conveyer 36*c* leads to a glass processing system (not shown). If the container is identified as a plastic bottle, it is dropped down to plastic bottle conveyer 36*b* (again, typically by a kicker in the on-load station) for delivery to a compacting system 40 which will be described in detail below. As indicated in the drawings, the depicted bottle B is a plastic bottle, and thus is passed from its position in the on-load station (as shown in FIG. 1) to the plastic bottle conveyer (as shown in FIG. 2).

Figure 3:
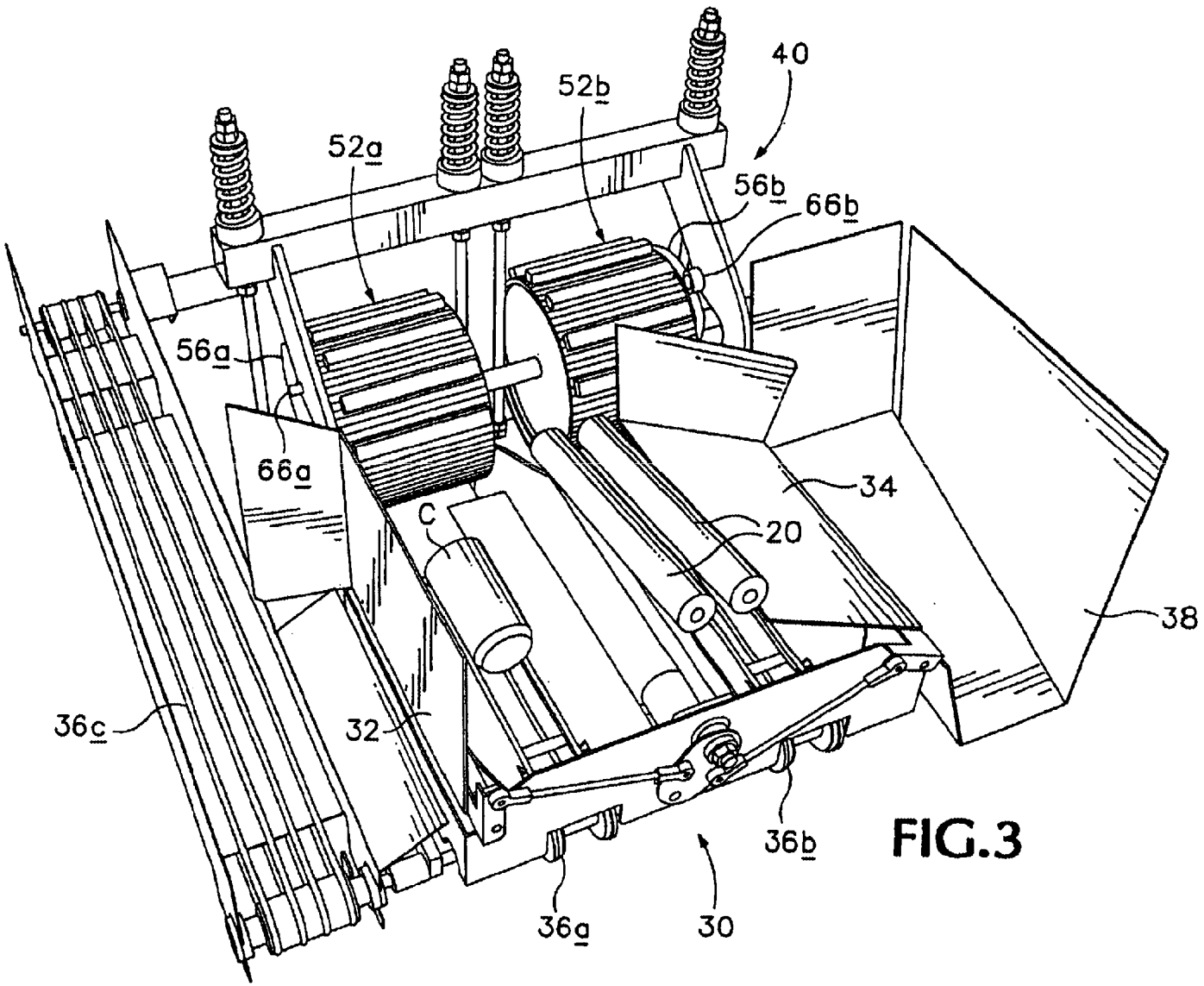
FIG. 3 is an isometric view similar to FIG. 2, but showing a metal can advancing along a metal can feed path.

In FIG. 3, the ramps are in a second configuration wherein ramp 32 defines a feed path for cans such as that shown at C, and ramp 34 defines a feed path for "unacceptable" items (items which are not returnable, or which could not be identified). Cans are dropped down onto metal can conveyer 36*a*. Unidentified items are fed downward along ramp 34 to reject chute 38 which returns the item to the user. FIG. 3 shows can C on the metal can conveyer ready for delivery to compacting system 40.

Once a container is placed on the appropriate conveyer, it is passed through the machine's container compacting system 40 where the container is compacted (e.g. crushed) between the system's roller assembly 50 and base plate assembly 60. Thereafter, the compacted container is delivered to a corresponding storage bin 42, 44. In the depicted machine, a metal can storage bin 42 is placed at the end of the metal can feed path, and a plastic bottle storage bin 44 is placed at the end of the plastic bottle feed path. A glass bottle storage bin (not shown) similarly may be placed at the end of the glass bottle feed path to receive glass bottles once they have been processed.

As indicated, roller assembly 50 includes a pair of rollers 52*a*, 52*b* each of which rotates on an axis defined by shaft 53. Shaft 53 is rotatably mounted on the frame. Each roller takes the form of a somewhat rigid drum with a container-engaging surface 54*a*, 54*b* configured to grip containers fed along conveyers 36*a*, 36*b*. Preferably, the rollers are provided with one or more protuberances 55 which enhance grip of the rollers to draw containers between the rollers and a base plate 62 as the rollers rotate.

Base plate 62 is a rigid plate mounted for pivot about an axis defined by shaft 63. Shaft 63 is mounted on the machine frame. The plate is configured for movement between a first orientation (FIG. 4) wherein the base plate is a first predetermined distance from the roller, and a second orientation (FIG. 5) wherein the base plate is a lesser second predetermined distance from the roller. A pair of support arms 64*a*, 64*b* are secured to the base plate, the support arms being configured to determine the spacing between the base plate and the roller as will be described below. The roller and base plate thus define a throat 70 which selectively may be opened to receive a container, and closed to crush a container between the roller and the base plate.

Figure 4:
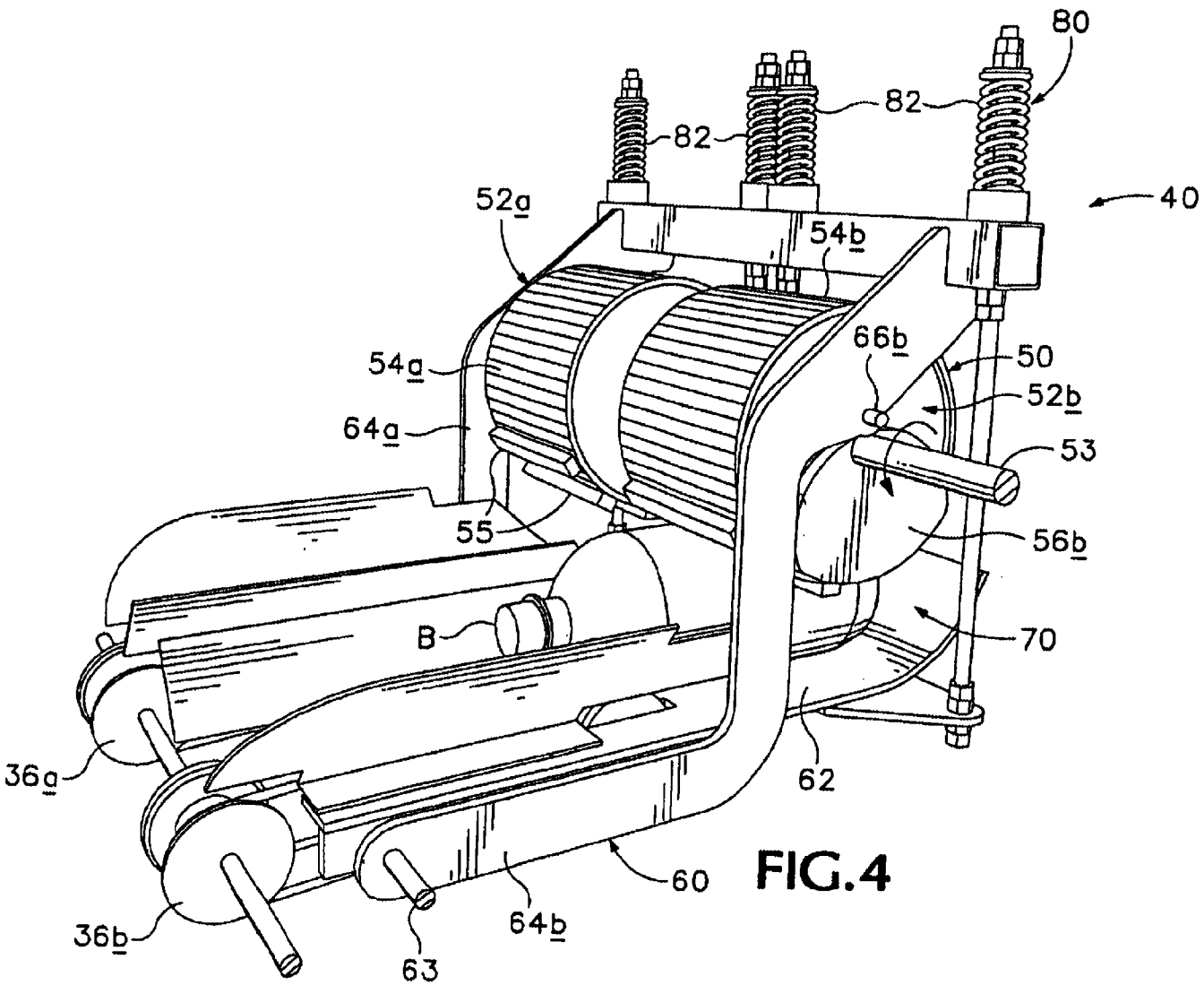
FIG. 4 is an isometric view of a container compacting system which forms a part of the recycling machine of FIG. 1, the base plate being shown in an open-throat first orientation.
Figure 5:
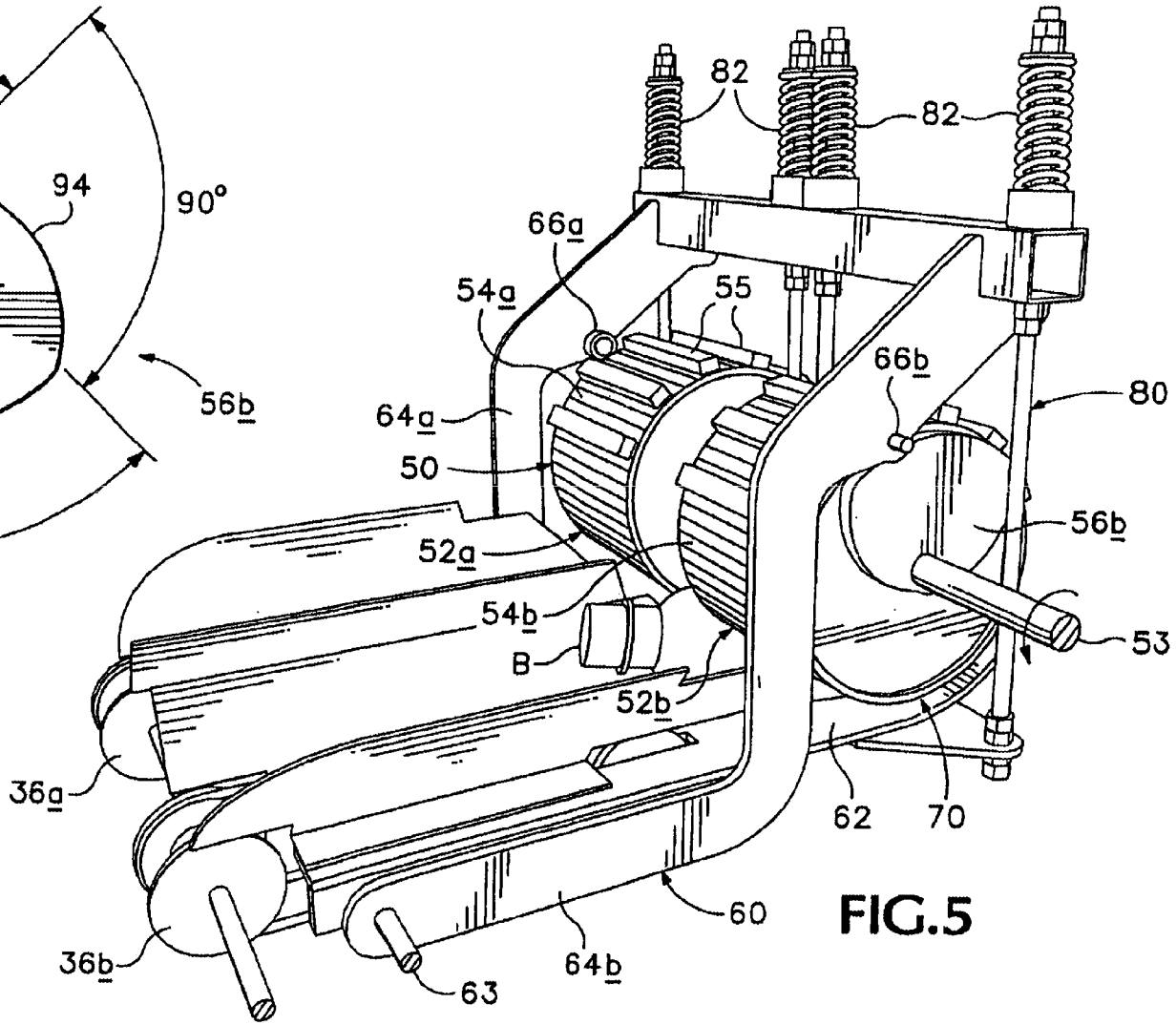
FIG. 5 is an isometric view of the container compacting system of FIG. 3, but with the base plate in a closed-throat second orientation.

In accordance with the invention, opening and closing of the container-receiving throat is effected by a cam arrangement which includes a pair of eccentric cams 56*a*, 56*b* mounted on shaft 53 for rotation with rollers 52*a*, 52*b*, and a corresponding pair of cam followers 66*a*, 66*b* mounted on support arms 64*a*, 64*b* of the base plate assembly. As the rollers rotate, the cam followers follow the contour of the cams, periodically raising and lowering the base plate. When the base plate is lowered, the container-receiving throat is opened to accommodate receipt of a container (FIG. 4). When the base plate is raised, the container-receiving throat is closed (FIG. 5) to compact the container.

A shock absorber arrangement 80 also may be provided to accommodate selected separation of the base plate and rollers upon inability to compact a container positioned between a roller and the base plate. In the depicted embodiment, the shock absorber arrangement includes a plurality of spring members 82 which secure the base plate to the support arms. Each spring member, it will be noted, includes a resilient spring. In the event of a difficulty in compacting a container, the springs will compress, opening the throat regardless of the relationship between the cam and cam follower. The spring tension determines the force required to open the throat, such spring tension typically being significantly higher than that required to compact a container.

Figure 6:
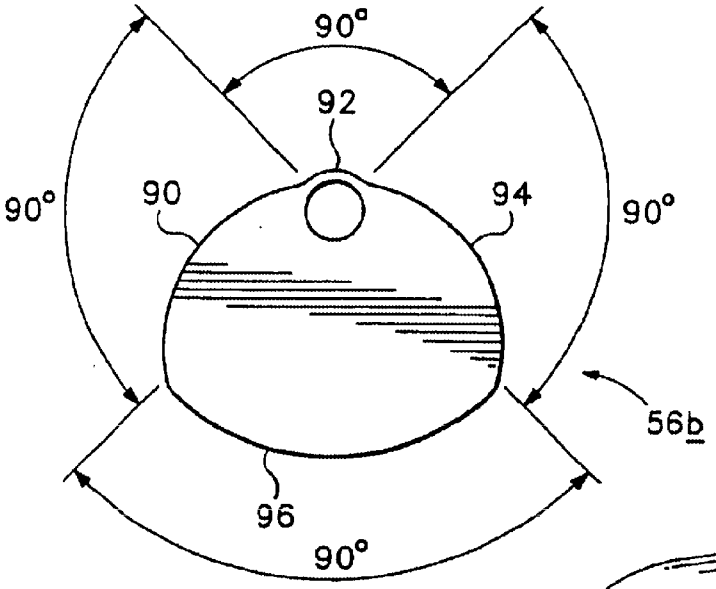
FIG. 6 is a side elevation view of a cam which forms a part of the container compacting system.

The shape of the cam is illustrated in FIG. 6, such cam being divided into four equal 90-degree quadrants 90, 92, 94, 96 which collectively determine base plate position throughout a container compacting cycle. As indicated, the cam defines a withdraw region 90, a first dwell region 92, an advance region 94 and a second dwell region 96. During passage of the cam follower over the withdraw region, the base plate is moved toward the first orientation, thereby opening the container-receiving throat so as to accommodate receipt of a container. Once the throat is opened, the base plate is kept in the first orientation while the cam follower passes over the first dwell region. Thereafter, the cam follower passes over the advance region whereby the cam provides for movement of the cam toward the second orientation, closing the container-receiving throat and compacting any container within the container-receiving throat. Finally, the cam follower passes over the second dwell region whereby the base plate is maintained in the second orientation during passage of the container entirely between the roller and the base plate.

Figure 7:
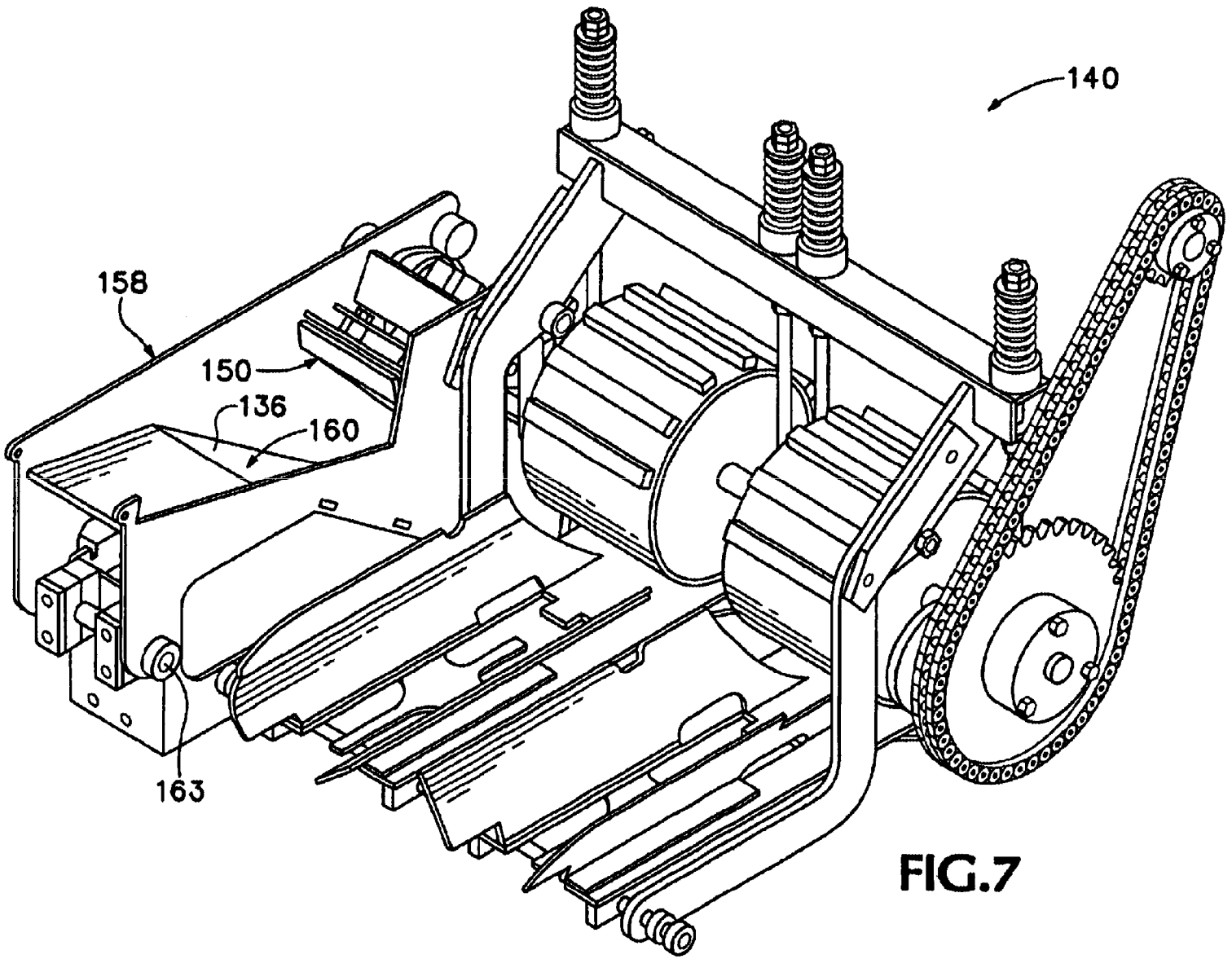
FIG. 7 is an isometric view of an alternative container compacting system constructed in accordance with the present invention.
Figure 8:
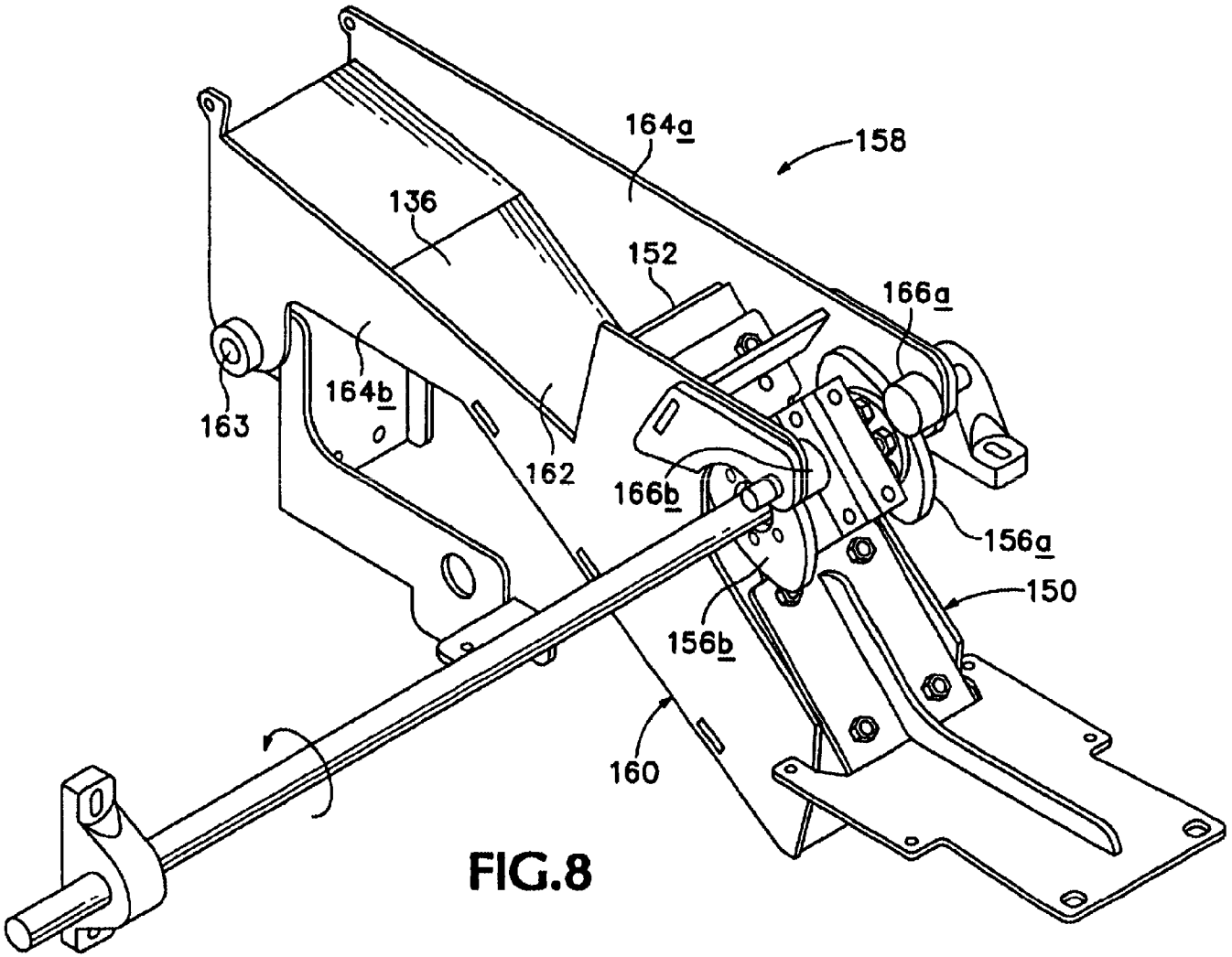
FIG. 8 is an isometric view of a bottle crusher of the alternative container compacting system of FIG. 7, the bottle crusher being shown in isolation.
Figure 9:
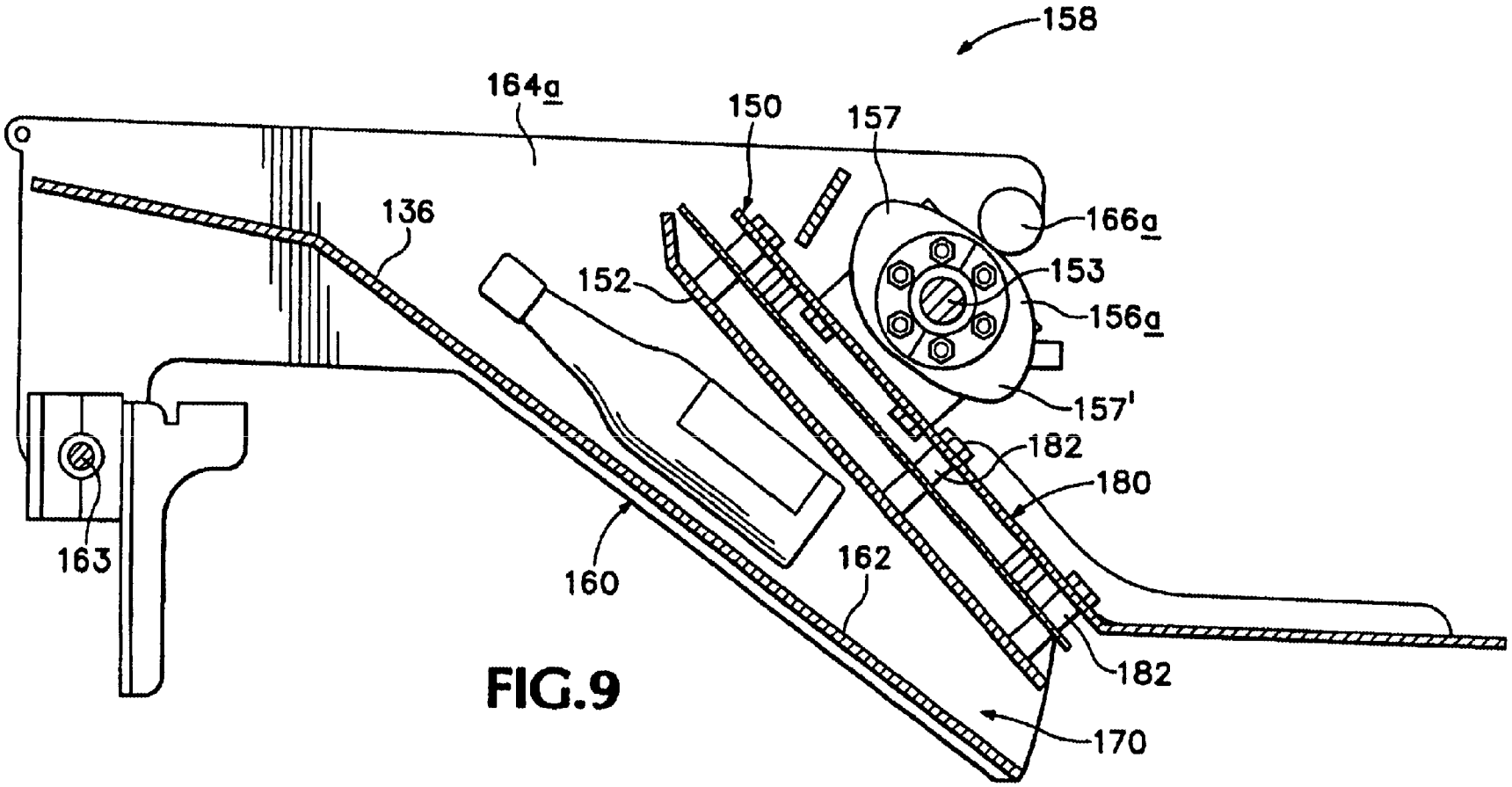
FIG. 9 is a sectional side elevation view of the bottle crusher shown in FIG. 8.

In an alterative embodiment container compacting system, shown at 140 in FIGS. 7–9, the glass bottle conveyor is removed and replaced with a glass crusher 158. Accordingly, upon identifying a container as an acceptable glass bottle (or alternatively, a bottle to be crushed), the bottle is directed along a glass bottle feed path to ramp 136. Ramp 136, in turn, feeds the glass bottle into glass crusher 158, where the glass is crushed between active surfaces of the glass crusher's stationary top plate assembly 150 and movable base plate assembly 160. Thereafter, the crushed glass is delivered to a corresponding storage bin (not shown). In the presently-described machine, a metal can storage bin typically would be placed at the end of the metal can feed path, a plastic bottle storage bin at the end of the plastic bottle feed path, and a glass storage bin at the end of the glass feed path.

As indicated, top plate assembly 150 includes a rigid top plate 152 which remains stationary relative to the frame. Top plate 152 defines a container-engaging surface configured to engage containers fed along ramp 136. Base plate assembly 160 includes a rigid base plate 162 mounted for pivotal movement about an axis defined by shaft 163. Shaft 163 typically is mounted on the machine frame. The base plate thus typically is configured for movement between a first orientation wherein the base plate is a first predetermined distance from the top plate to accommodate receipt of containers in an open container-receiving throat 170, and a second orientation wherein the base plate is a lesser second predetermined distance from the top plate so as to close the container-receiving throat, crushing any container or containers therein.

A pair of support arms 164*a*, 164*b* typically are secured to the base plate, the support arms being configured to determine the spacing between the base plate and the top plate. The top plate and base plate thus define throat 170 which selectively may be opened to receive a container, and closed to crush the container between the top plate and the base plate as described above.

In accordance with the invention, opening and closing of the container-receiving throat is effected by a cam arrangement which includes a pair of elliptical cams 156*a*, 156*b* mounted on shaft 153 for rotation with shaft 153, and a corresponding pair of cam followers 166*a*, 166*b* mounted on support arms 164*a*, 164*b* of the base plate assembly (and thus operatively mounted on the base plate). As the rollers rotate, the cam followers track the contour of the cams, periodically raising and lowering the base plate. When the base plate is lowered, the container-receiving throat is opened to accommodate receipt of a container (FIG. 9). When the base plate is raised, the container-receiving throat is closed to compact (or crush) the container.

A shock absorber arrangement 180 also may be provided to accommodate selected separation of the base plate and top plate upon inability to compact a container positioned between a top plate and the base plate. In the depicted embodiment, the shock absorber arrangement includes a plurality of spring members 182 which secure the top plate to the frame. Each spring member, it will be noted, includes a resilient spring. In the event of a difficulty in compacting a container, the springs will compress, opening the throat regardless of the relationship between the cam and cam follower. The spring tension determines the force required to open the throat, such spring tension typically being significantly higher than that required to compact a container.

The shape of the cam is illustrated in FIG. 9, such cam being divided into sections which collectively determine base plate position throughout a container compacting cycle. As indicated, the cam may be constructed from plural cam pieces 157, 157', each mounted eccentrically on cam shaft 153 to define an elliptical cam. As indicated, the cam pieces may be configured to cooperatively clamp the cam shaft to form a substantially continuous camming surface surrounding the cam shaft. The cam pieces thus may be readily removable and replaceable to alter contour of the camming surface. Each cam typically defines at least one withdraw region and at least one advance region. During passage of the cam follower over the withdraw region, the base plate is moved toward the first orientation, thereby opening the container-receiving throat so as to accommodate receipt of a container. Thereafter, the cam follower passes over the advance region whereby the cam provides for movement of the base plate toward the second orientation, closing the container-receiving throat and crushing any container within the container-receiving throat.

A container recycling machine for use in the recycling various types of containers thus may be provided wherein the machine includes an on-load station configured to receive a container, a sensor mounted adjacent the on-load station to identify the received container while in the on-load station, a conveyer mechanism for directing the identified container from the on-load station along a feed path which corresponds to the identified container type, and first and second container compactors, each disposed along a feed path for a different-type container. The first container compactor may be disposed along a feed path for a first-type container, the first container compactor including a roller mounted for rotation about a roller axis, a roller cam mounted for rotation with the roller about the roller axis, a base plate operatively pivotally mounted to the frame, and a cam follower operatively secured to the base plate for movement under driving influence of the cam to effect movement of the base plate between a first orientation defining an open throat for receipt of the first-type container and a second orientation defining a closed throat for crushing the first-type container. The second compactor may be disposed along a feed path for a second-type container, the second container compactor including a top plate operatively mounted on the frame, a cam operatively mounted to the frame for rotation about a cam axis, a base plate, and a cam follower operatively secured to the base plate to form at least a portion of a driving connection between the top plate and the base plate, the base plate being operatively pivotally mounted on the frame for movement with the cam follower, under driving influence of the cam, between a first orientation defining an open throat for receipt of the second-type container, and a second orientation defining a closed throat for crushing the second-type container.

Although a preferred embodiment of the reverse vending machine has been disclosed, it should be appreciated that variations and modification may be made thereto without departing from the spirit of the invention as claimed.

We claim:

1. A container compacting system comprising:

a frame;

a top plate assembly including a top plate operatively mounted on the frame and a cam operatively mounted to the frame for rotation about a cam axis; and a base plate assembly including a base plate and a cam follower operatively secured to the base plate to form at least a portion of a driving connection between the top plate and the base plate, the base plate being operatively pivotally mounted on the frame for movement with the cam follower, under driving influence of the cam, between a first orientation wherein the base plate is a first predetermined distance from the top plate so as to define an open container-receiving throat, and a second orientation wherein the base plate is a second lesser predetermined distance from the top plate so as to close the container-receiving throat.

2. The container compacting system of claim 1, wherein the cam is eccentrically mounted on the cam axis.

3. The container compacting system of claim 1, wherein the cam includes a plurality of cam pieces, each mounted eccentrically on a cam shaft to define an elliptical cam.

4. The container compacting system of claim 3, wherein the cam pieces are configured to cooperatively clamp the cam shaft to form a substantially continuous camming surface surrounding the cam shaft.

5. The container compacting system of claim 4, wherein the cam pieces are readily removable and replaceable to alter contour of the camming surface.

6. The container compacting system of claim 1, wherein the cam defines a camming surface with a withdraw region along which the cam follower travels to provide for movement of the base plate toward the first orientation, a dwell region along which the cam follower travels to maintain the base plate in the first orientation, and an advance region along which the cam follower travels to provide for movement of the base plate toward the second orientation.

7. The container compacting system of claim 1, wherein the top plate is operatively mounted on the frame via a shock absorber arrangement.

8. A glass compacting system comprising:

a frame;

a stationary plate operatively mounted on the frame a cam operatively mounted to the frame for rotation about a cam axis;

a moving plate operatively pivotally mounted on the frame; and a cam follower operatively secured to the movable plate to form at least a portion of a driving connection between the movable plate and the stationary plate;

wherein the moving plate is movable with the cam follower under driving influence of the cam between a first orientation wherein the moving plate is a first predetermined distance from the stationary plate so as to define an open container-receiving throat for receipt of a glass container, and a second orientation wherein the moving plate is a second lesser predetermined distance from the moving plate so as to close the container-receiving throat, thereby crushing the glass container.

9. The glass compacting system of claim 8, wherein the cam is eccentrically mounted on the cam axis.

10. The glass compacting system of claim 8, which further comprises a cam shaft mounted for rotation about the cam axis, and wherein the cam includes a pair of cam pieces, each mounted eccentrically on the cam shaft to define an elliptical cam.

11. The container compacting system of claim 10, wherein the cam pieces are configured to cooperatively clamp the cam shaft to form a substantially continuous camming surface surrounding the cam shaft.

12. The container compacting system of claim 11, wherein the camming surface includes a withdraw region along which the cam follower travels to provide for movement of the moving plate toward the first orientation, a dwell region along which the cam follower travels to maintain the moving plate in the first orientation, and an advance region along which the cam follower travels to provide for movement of the moving plate toward the second orientation.

13. The container compacting system of claim 12, wherein the cam pieces are readily removable and replaceable to alter contour of the camming surface.

14. A container recycling machine for use in the recycling various types of containers, the machine comprising:

an on-load station configured to receive a container;

a sensor mounted adjacent the on-load station to identify the received container while in the on-load station;

a conveyer mechanism for directing the identified container from the on-load station along a feed path which corresponds to the identified container type;

a first container compactor disposed along a feed path for a first-type container, the first container compactor including a roller mounted for rotation about a roller axis, a roller cam mounted for rotation with the roller about the roller axis, a base plate operatively pivotally mounted to the frame, and a cam follower operatively secured to the base plate for movement under driving influence of the cam to effect movement of the base plate between a first orientation defining an open throat for receipt of the first-type container, and a second orientation defining a closed throat for crushing the first-type container; and a second container compactor disposed along a feed path for a second-type container, the second container compactor including a top plate operatively mounted on the frame, a cam operatively mounted to the frame for rotation about a cam axis, a base plate, and a cam follower operatively secured to the base plate to form at least a portion of a driving connection between the top plate and the base plate, the base plate being operatively pivotally mounted on the frame for movement with the cam follower, under driving influence of the cam, between a first orientation defining an open throat for receipt of the second-type container, and a second orientation defining a closed throat for crushing the second-type container.

* * * * *